US006855382B2

(12) United States Patent
Barcock et al.

(10) Patent No.: US 6,855,382 B2
(45) Date of Patent: Feb. 15, 2005

(54) POROUS INK-JET RECORDING MATERIAL

(75) Inventors: Richard Anthony Barcock, Aylesbury (GB); Alastair Stuart Dodds, Harlow (GB); Aidan Josph Lavery, Aylesbury (GB); Marguerite Claire Quinn, London (GB)

(73) Assignee: Felix Schoeller jr. Foto-und Spezialpapiere GmbH & Co.KG (DE)

( * ) Notice: Subject to any disclaimer, the term of this patent is extended or adjusted under 35 U.S.C. 154(b) by 212 days.

(21) Appl. No.: 10/055,073

(22) Filed: Jan. 23, 2002

(65) Prior Publication Data

US 2003/0152721 A1 Aug. 14, 2003

(30) Foreign Application Priority Data

Jan. 26, 2001 (DE) ..... 101 03 716

(51) Int. Cl.[7] ..... B41M 5/40

(52) U.S. Cl. ..... 428/32.24; 428/32.25; 428/32.26; 428/32.35

(58) Field of Search ..... 428/32.24, 32.25, 428/32.26, 32.35

(56) References Cited

U.S. PATENT DOCUMENTS

| | | | | | |
|---|---|---|---|---|---|
| 4,460,637 | A | * | 7/1984 | Miyamoto et al. | 428/212 |
| 4,780,356 | A | * | 10/1988 | Otouma et al. | 428/212 |
| 5,472,757 | A | * | 12/1995 | Ogawa et al. | 428/40 |
| 5,759,673 | A | * | 6/1998 | Ikezawa et al. | 428/198 |
| 5,911,855 | A | * | 6/1999 | Dransmann et al. | 162/135 |
| 6,149,995 | A | * | 11/2000 | Peiffer et al. | 428/35.8 |
| 6,165,606 | A | * | 12/2000 | Kasahara et al. | 428/323 |
| 6,177,188 | B1 | * | 1/2001 | Ichioka et al. | 428/342 |
| 6,497,480 | B1 | * | 12/2002 | Wexler | 347/102 |
| 6,502,935 | B1 | * | 1/2003 | Barcock et al. | 347/105 |
| 6,610,389 | B2 | * | 8/2003 | Ishimaru et al. | 428/195 |
| 2002/0034613 | A1 | * | 3/2002 | Liu et al. | 428/195 |

FOREIGN PATENT DOCUMENTS

| | | |
|---|---|---|
| EP | 0 685 344 B1 | 6/1999 |
| EP | 1 038 691 A1 | 9/2000 |
| EP | 1 048 479 A2 | 11/2000 |
| EP | 1 048 480 A1 | 11/2000 |
| WO | WO 97/20691 | 6/1997 |

* cited by examiner

*Primary Examiner*—B. Shewareged
(74) *Attorney, Agent, or Firm*—Cook, Alex, McFarron, Manzo, Cummings & Mehler, Ltd.

(57) ABSTRACT

An ink-jet recording material comprising a support material and at least a lower and an upper pigment-containing layer wherein the pigment of the upper layer is present in two particle size distributions (A, B) and one particle size distribution (A) is in the range of 10 to 100 nm and the other particle size distribution (B) is in the range of 1,000 to 3,000 nm, and wherein the pigment of the upper layer is different from the pigment of the lower layer and wherein the average particle size of the pigment of the upper layer is different from the average particle size of the pigment of the lower layer.

12 Claims, No Drawings

POROUS INK-JET RECORDING MATERIAL

FIELD OF THE INVENTION

The invention relates to an recording material for the Ink-jet-printing process with a base paper and at least one pigment containing lower layer and at least one pigment containing upper layer.

BACKGROUND OF THE INVENTION

In the ink jet recording method tiny ink droplets are applied onto a recording material with the aid of different techniques, which have been already described several times, and received by the recording material.

Different requirements are placed on the recording material such as high color density of the printed dots, a fast ink reception and a sufficient wiping fastness connected therewith, a dye diffusion in the transverse direction of the printed dots (bleed) which does not surpass the required degree as well as minimal mottle and a high water fastness. Further requirements, in particular for photo-like prints are a homogeneous print gloss and surface gloss of the recording material.

Ink-jet printing processes have become very important over recent years. The recording layers originally contained a considerable fraction of a binder which bulks in water, for example, polyvinyl alcohol and gelatin. This binder was either applied to the raw paper or to a substrate coated with a polyolefin. Such materials have the advantage that they provide a gloss and very high color densities after printing. This also applies to systems based on gelatin. However, long drying times are a major disadvantage so that the surface quality can be impeded when handling the prints.

In the past few years development has moved to so-called more mesoporous systems which due to voids in the applied layer, can quickly absorb the ink during printing and which are in particular suitable for print heads of the piezo type. In general, these recording materials contain a high pigment fraction. The pigment size is in the nanometer range, in particular below the wavelength of visible light, i.e. pigments are thus smaller than 400 nm, so as to ensure a glossy surface. These recording materials provide excellent image quality due to good color fixation. They have a short drying time, and there are no problems with coalescence and bleed. However, such mesoporous systems react sensitively to exposure to light and ozone. Silver salt photographs are light-resistant over a period of 15 to 20 years, and ink-jet images should be light-resistant for at least the same period.

U.S. Pat. Nos. 4,879,155, 5,104,730, 5,264,275 and 5,275,867 describe porous recording layers containing boehmite. EP 0 631 013 B1 describes a boehmite which is applied to a porous silica layer for producing an ink-jet recording material. However, boehmite pigments are often associated with problems in relation to light resistance of magenta colors.

For the production of a porous recording layer, U.S. Pat. No. 5,965,244 proposes mixing porous silica with colloidal silica. Further distribution of the particle sizes is preferred to increase packing density of the particles and to improve ink movement caused by capillary action of the pores.

SUMMARY OF THE INVENTION

It is the object of the invention to provide a recording material for the ink-jet printing process with high gloss, high color density, light stability, a large toning range and high image resolution. Furthermore, the recording material is to feature a short drying time, good water resistance and good ink absorption.

This object is met by an ink-jet recording material comprising a support material and at least a lower and an upper pigment-containing layer wherein the pigment of the upper layer is present in two particle size distributions (A, B) and particle size distribution (A) is in the range of 10 to 100 nm and the other particle size distribution (B) is in the range of 1,000 to 3,000 nm and wherein the pigment of the upper layer is different from the pigment of the lower layer and wherein the average particle size of the pigment of the upper layer is different from the average particle size of the pigment of the lower layer.

According to the invention, such a pigment with accumulations of particle sizes in two different places of the particle size scale is referred to as a bimodal pigment. The different particle sizes can be based on the formation of differently sized secondary particles (agglomerates) of a pigment. They can also be based on one part of the pigment being present as primary particles while another part of the pigment is present as secondary particles.

Surprisingly it has been found that the recording material according to the invention is suitable for inks which contain dyes and for inks containing pigments. This provides universal usability in a range of different printers. The construction according to the invention, of the two layers, provides quick absorption of the ink fluid by the lower layer, with the dyes or color pigments of the ink being fixed at the surface of the upper layer. Presumably, the pigments selected according to the invention form a system of cross-linked pores in the upper layer.

DETAILED DESCRIPTION OF THE INVENTION

The pigment which is used according to the invention in the upper layer, shows a particle distribution ranging from 10 to 100 nm with an average particle size of 70 to 90 nm, particularly preferred 75 to 85 nm and a further distribution ranging from 1,000 to 3,000 nm with an average particle size of 2,300 to 2,800 nm, particularly preferred 2,400 to 2,600 nm. The upper layer is the layer onto which the ink fluid is applied by the print head of the printer.

The particle size of the larger pigment particles of the upper layer is preferably 20 to 30 times the particle size of the smaller pigment particles of the upper layer. Usually, large pigment particles cause a reduction in gloss. Surprisingly it has however been found that the gloss of the recording material according to the invention is not negatively affected as a result of the large pigment particles in the upper layer.

The weight ratio of the pigment particles of the fraction A to the pigment particles of fraction B is preferably 8:1 to 20:1, in particular 10:1 to 15:1.

For example alumina, aluminum hydroxide, aluminum hydrate, silica, barium sulphate and titanium dioxide are suitable pigments, according to the invention, of the upper layer. Particularly preferably, the pigment of the upper layer is a pigment based on alumina, and is mainly amorphous.

The average particle size of the pigment particles of the lower layer is preferably 3 to 4 times the average particle size of the smaller particles of the upper layer. Preferably the particle size distribution of the pigment of the lower layer ranges from 150 to 1,000 nm with an average particle size of 240 to 350 nm, preferably 260 to 290 nm.

Suitable pigments according to the invention for the lower layers are, for example, alumina, aluminum hydroxide, aluminum hydrate, silica, barium sulphate and titanium dioxide. A particularly preferred pigment of the lower layer is a pigment based on amorphous silica. Such a pigment can be cationically modified.

The upper and the lower layers comprise a binder common in paper coating. Preferably, the binder is a water soluble and/or water dispersible polymer. For example, the following are suitable binders: polyvinyl alcohol, completely or partially saponified; cationically modified polyvinyl alcohol; polyvinyl alcohol comprising silyl groups; polyvinyl alcohol comprising acetal groups, gelatin, polyvinyl pyrrolidone, starch, hydroxyethyl starch, carboxymethyl cellulose, polyethylene oxide, polyethylene glycol; styrene/butadiene latex and styrene/acrylate latex. The quantity of the binder in the upper and in the lower layer is 5 to 35, preferably 10 to 30% by weight, in relation to the weight of the dried layer.

The upper and the lower layer can contain additives and auxiliary agents which are usual for ink absorption layers, e.g. tensides, cross-linking agents and color fixing means such as polyammonia compounds.

According to a further preferred embodiment of the invention, between the upper and the lower layers there is a layer comprising cross-linking agents. For example epichlorohydrin, boric acid, boric acid salts, boron oxides, 3-glycideoxypropyltrimethoxysilane, titanium (IV) diisopropoxidebis (acetylacetonate), titanium (IV)(triethanol aminate)isopropoxide, glyoxal and chrome alum are suitable cross-linking agents. The application quantity can be 0.25 to 0.5 g/m$^2$.

It was found that a layer of cross-linking agents between the lower and the upper layers prevents the binder from penetrating from the upper into the lower layer. Thus the layer of cross-linking agent functions as a barrier layer for the binder. Consequently, the surface of the recording material is smooth, which makes an overall contribution to increased gloss.

The cross-linking agent can also be added to the pigment/binder mixture which is used to form the upper and/or lower layer, and it can be applied to the support material with the mixture, as a component in the mixture. The weight of the cross-linking agent in the layer can be 0.1 to 2.0% by weight, in particular 0.2 to 1.5% by weight, in relation to the weight of the dried layer.

The lower layer can be formed directly on the support material. The application thickness of the lower layer can be 10 to 60 $\mu$m, preferably 20 to 50 $\mu$m. The upper layer can be formed directly on the lower layer or on the layer comprising the cross-linking agents. The application thickness of the upper layer can be 10 to 60 $\mu$m, preferably 20 to 50 $\mu$m.

In principle, any raw paper can be used as a support material. Preferably, surface-sized, calendered or non-calendered or heavily sized raw papers are used. The paper can be acid sized or neutral sized. The raw paper should comprise excellent dimensional stability and should be able to absorb the liquid contained in the ink without becoming wavy. Papers with high dimensional stability, made from cellulose mixtures of pine cellulose and eucalypt cellulose are particularly suitable. In this context, it is referred to the disclosure in DE 196 02 793 B1 where a raw paper for an ink-jet recording material is described and which is incorporated herein by reference. The raw paper can comprise further auxiliary agents and additives which are common in the paper industry, such as dyes, optical brighteners or antifoaming agents. The use of waste cellulose and/or reprocessed waste paper is also possible.

A paper which has been coated with polyolefins, in particular with polyethylene, on one side or on both sides, is particularly suitable as a support material. Also suitable is a paper coated with barium sulphate. Also plastic foils for example, made of polyester or polyvinylchloride, are suitable as support materials. The basis weight of the support material can range from 80 to 300 g/m$^2$.

To apply the layers, any generally known application and dosing method can be used, such as application and dosing methods using rollers, engraving, flooding and air brushes or roll squeegees. Particularly preferred is the application by means of a cascade coating plant or a feed hopper with slot die.

In order to set curl behavior, antistatic and transportability in the printer, the back side can comprise a separate functional layer. Suitable back side layers are described in DE 43 08 274 A1 and DE 44 28 941 A1; reference is made to their disclosure.

The following examples serve to further illustrate the invention.

EXAMPLES

For the following tests, a paper neutrally sized with alkyl ketene dimer and coated on both sides with polyethylene, comprising a weight of 100 g/m$^2$ was used as a support material. The polyethylene is of the type LDPE. The front coating further comprises 0.95% by weight of an optical brightener, 10% by weight of titanium dioxide, 4% by weight of slip additive and 10.8% by weight, in relation to the mass of the layer, of a pigment concentrate comprising 10% by weight ultramarine and 90% by weight LDPE.

Example 1

To produce the lower layer, silicic acid, polyvinyl alcohol and boric acid were mixed, heated to 40° C. and agitated for 30 minutes. In relation to the mass of the mixture obtained, 0.05% by weight of Triton X100 was added and the preparation was set to a solids content of 15%. For the lower layer, the mixture obtained was applied to the support material coated with polyethylene, using a feed hopper with slot die, and was dried for three minutes at 100° C. The dry application weight was 18 g/m$^2$.

To produce the coating mass for the upper layer, aluminum oxide, polyvinyl alcohol and boric acid were mixed and heated to 40° C. The mixture was stirred for 30 minutes and set to a solids content of 20%. Using a feed hopper with slot die, the coating mass for the upper layer was applied to the support material which had previously been coated, and subsequently dried for four minutes at 100° C. The dry application weight was 20 g/m$^2$.

Table 1 below lists the details of the ingredients of the layers.

TABLE 1

| Ingredients | Lower layer | Upper layer |
|---|---|---|
| Silica, average particle size 250 nm | 71.0 | — |
| Alumina, average particle size 80 nm (A), 2,500 nm (B) ratio A:B = 15:1 | — | 86.6 |
| Polyvinyl alcohol degree of saponification 88 mol % | 28.5 | 12.4 |
| Boric acid | 0.5 | 1.0 |

The values in the table are expressed in percent by weight. They relate to the dry weight of the layer.

Example 2

The composition of the upper and the lower layers is the same as in Example 1 except that the upper layer does not contain any boric acid. Instead, on the support material coated with the lower layer, a 5% boric acid solution was applied as an intermediate coating, to obtain a coating with an application thickness of 0.4 g/m$^2$. Application of the upper layer with the composition known from Example 1, onto the intermediate layer with the cross-linking agent was carried out according to the wet-on-wet coating process.

Comparison Example 1 (V1)

The composition of the lower layer of Comparison Example 1 is identical to that of Example 1. The thickness of the layer applied is the same.

To produce the upper layer, aluminium oxide with an average particle size of 160 to 170 nm, polyvinyl alcohol and boric acid were mixed and heated to 40° C. The mixture was agitated for 30 minutes. The mixture obtained was applied to the previously coated support material and subsequently dried for four minutes at 100° C. The dry application weight was 20 g/m$^2$.

The alumina used in this instance was not a so-called bimodal alumina with accumulations of the particle size in two different locations of the size scale, but instead mono dispersed alumina was used.

Comparison Example 2 (V2)

Alumina with an average particle size of 1.56 $\mu$m, polyvinyl alcohol and boric acid were mixed and heated to 40° C. They were agitated for 30 minutes and 0.05% Triton X100 was admixed. The mixture obtained for the lower layer was applied to the support material coated with polyethylene, and dried at 100° C. for three minutes. The dry application weight was 18 g/m$^2$.

Table 2 below lists the details of the ingredients of the layers.

TABLE 2

| | Lower layer | | Upper layer | |
|---|---|---|---|---|
| Ingredients | V1 | V2 | V1 | V2 |
| Silica, average particle size 250 nm | 71 | — | — | — |
| Alumina, average particle size 165 nm | — | — | 87.3 | — |
| Alumina, average particle size 1,560 nm | — | 85.7 | — | — |
| Alumina example 1 | — | — | — | 89.7 |
| Polyvinyl alcohol, degree of saponification 88 mol % | 28.5 | 14.3 | 12.4 | 9.3 |
| Boric acid | 0.5 | — | 0.3 | 1.0 |

The values in the table are expressed in percent by weight. They relate to the dry weight of the layer.

Tests

The recording materials obtained were checked for color density, gloss and print gloss, absorptive capacity, water resistance and light resistance.

Color density—The color density was measured using an X-Rite densitometer type 428 on the colors cyan, magenta, yellow and black. The tests were based on color prints from various printer types. The higher the value of a particular color, the better the color density.

Gloss—The gloss was measured using a gloss meter from the company Dr. Lange GmbH according to DIN 67530 at an angle of 60°. Measurements were taken on a blank recording sheet.

Print gloss—The print gloss was measured using a gloss meter from the company Dr. Lange GmbH according to DIN 67530 at angles of 20° and 60°. Measurements were taken on a part of the recording sheet that had been printed black.

Absorptive capacity—The absorptive capacity was determined with the standard Cobb$_{60}$ test using demineralised water.

Water resistance—To test the water resistance, the color density of a printout was determined; the recording sheet was then immersed for 1 minute in a water bath containing water at a temperature of 25° C. The sheet was dried and subsequently the color density was determined visually, i.e. marks from 1 (very good) to 5 were awarded, and the difference in color density before and after treatment with water was determined.

Light resistance—The printed specimens were placed in an ATLAS 3000i Weatherometer for 24 hours at 30° C. and at a relative air humidity of 60%. Evaluation of color bleaching was carried out for each color, according to the CIE L*a*b* system, before and after the above-mentioned treatment. The CIE L*a*b* values were acquired using an X-Rite Color Swatchbook.

The results of the tests are listed in Tables 3 to 8.

TABLE 3

Determining the color density of color blocks and the water resistance

| | Color density | | | |
|---|---|---|---|---|
| Printer Epson 740 | Example 1 | Example 2 | Comparison example 1 | Comparison example 2 |
| Black | 2.32 | 2.42 | 1.71 | 2.10 |
| cyan | 2.39 | 2.50 | 1.60 | 1.92 |
| Magenta | 1.79 | 1.88 | 1.18 | 1.42 |
| Yellow | 1.29 | 1.32 | 1.06 | 1.08 |
| Overall color density | 7.79 | 8.12 | 5.55 | 6.52 |
| Water resistance | 1.5 | 1 | 4 | 5 |

TABLE 4

Determining the color density of color blocks

| | Color density | | | |
|---|---|---|---|---|
| Printer HP970cxi | Example 1 | Example 2 | Comparison example 1 | Comparison example 2 |
| Black | 1.81 | 1.88 | 1.14 | 1.49 |
| Cyan | 1.24 | 1.24 | 1.12 | 1.19 |
| Magenta | 1.99 | 1.99 | 1.28 | 1.76 |
| yellow | 1.25 | 1.24 | 0.86 | 1.11 |
| Overall color density | 6.29 | 6.35 | 4.40 | 5.55 |

TABLE 5

Determining the color density of color blocks

| Printer Canon BJC8200 | Color density | | | |
|---|---|---|---|---|
| | Example 1 | Example 2 | Comparison example 1 | Comparison example 2 |
| Black | 2.11 | 2.15 | 1.5 | 1.85 |
| Cyan | 2.33 | 2.31 | 1.55 | 1.93 |
| Magenta | 1.66 | 1.68 | 1.21 | 1.48 |
| yellow | 0.89 | 0.88 | 0.85 | 0.86 |
| Overall color density | 6.99 | 7.02 | 5.11 | 6.12 |

TABLE 6

Determining the print gloss

| Color block Printer | Black | | | |
|---|---|---|---|---|
| | Example 1 | Example 2 | Comparison example 1 | Comparison example 2 |
| Epson 740 | 45.2 | 44.7 | 42.7 | 16.2 |
| HP970cxi | 44.1 | 43.1 | 46.0 | 18.4 |
| Canon 8200 | 40.2 | 39.6 | 44.2 | 15.2 |

TABLE 7

ΔE of color blocks after 24 hours exposure to light

| Specimen | K | C | M | Y | B | G | R | Total | Substrate |
|---|---|---|---|---|---|---|---|---|---|
| Example 1 | 0.20 | 3.14 | 0.17 | 0.93 | 1.09 | 5.82 | 4.09 | 15.44 | 3.01 |
| Comparison example 2 | 1.24 | 4.12 | 5.61 | 10.47 | 6.74 | 12.99 | 12.76 | 53.93 | 5.38 |
| Konica QP industry standard | 1.72 | 7.27 | 0.94 | 5.18 | 4.47 | 14.60 | 5.78 | 39.96 | 2.31 |

TABLE 8

Water absorption and gloss measurement

| | Example 1 | Example 2 | Comparison example 1 | Comparison example 2 |
|---|---|---|---|---|
| $Cobb_{60}$ (g/m$^2$) | 36 | 45 | 31 | 48 |
| Gloss (60°) | 34.0 | 34.1 | 39.6 | 15.0 |
| Gloss (20°) | 12.9 | 12.9 | 13.5 | 2.3 |

What we claims is:

1. An ink-jet recording material comprising a support material and at least a lower and an upper pigment containing layer wherein the pigment of the upper layer is present in two particle size distributions (A,B), particle size distribution (A) is in the range of 10 to 100 nm, and the other particle size distribution (B) is in the range of 1,000 to 3,000 nm, wherein the weight ratio of A:B is 8:1 to 20:1, and wherein the pigment of the upper layer is different from the pigment of the lower layer and the average particle size of the pigment of the upper layer is different from the average particle size of the pigment of the lower layer.

2. An ink-jet recording material according to claim 1, wherein the pigment of the upper layer is based on alumina and is mainly amorphous.

3. An ink-jet recording material according to claim 1, wherein the particle size distribution of the pigment of the lower layer is in the range of 150 to 1,000 nm.

4. An ink-jet recording material according to claim 1, wherein the particle size distribution of the pigment of the lower layer is in the range of 150 to 1,000 nm.

5. An ink-jet recording material according to claim 2, wherein the particle size distribution of the pigment of the lower layer is in the range of 150 to 1,000 nm.

6. An ink-jet recording material according to claim 1, wherein the pigment of the lower layer is based on silica and is amorphous.

7. An ink-jet recording material according to claim 3, where the pigment of the lower layer is based on silica and is amorphous.

8. An ink-jet recording material according to claim 7, wherein the pigment of the lower layer is cationically modified.

9. An ink-jet recording material according to claim 1, wherein the support material is a polyolefin coated paper.

10. An ink-jet recording material comprising a support material and at least a lower and an upper pigment containing layer wherein the pigment of the upper layer is present in two particle size distributions (A,B), particle size distribution (A) is in the range of 10 to 100 nm, and the other particle size distribution (B) is in the range of 1,000 to 3,000 nm, wherein the pigment of the upper layer is different from the pigment of the lower layer and the average particle size of the pigment of the upper layer is different from the average particle size of the pigment of the lower layer, and wherein a cross-linking agent containing layer is provided between the lower and the upper layer.

11. An ink-jet recording material according to claim 10, wherein the cross-linking agent is selected from the group consisting of epichlorohydrin, boric acid, boric acid salts, boron oxides, 3-glycidoxypropyltrimethoxysilane, titanium (IV) diisopropoxydbis (acetylacetonate), titanium (IV) (triethanol aminate)isopropoxide, glyoxal and chrome alum.

12. An ink-jet recording material comprising a support material and at least a lower and an upper pigment containing layer wherein the pigment of the upper layer consists essentially of two particle size distributions (A,B), particle size distribution (A) is in the range of 10 to 100 nm, and the other particle size distribution (B) is in the range of 1,000 to 3,000 nm, and wherein the pigment of the upper layer is different from the pigment of the lower layer and the average particle size of the pigment of the upper layer is different from the average particle size of the pigment of the lower layer.

* * * * *